US005281989A

United States Patent [19]

Sitte

[11] Patent Number: 5,281,989

[45] Date of Patent: Jan. 25, 1994

[54] INSERT FOR PAPER PROCESSORS

[76] Inventor: Ernst-Adolf Sitte, Am Floth 16, D-3258 Gross Berkel, Fed. Rep. of Germany

[21] Appl. No.: 784,557

[22] Filed: Oct. 29, 1991

[30] Foreign Application Priority Data

Nov. 5, 1990 [JP] Japan ..... 2-300910

[51] Int. Cl.[5] ..... G03D 3/08

[52] U.S. Cl. ..... 354/320; 354/321

[58] Field of Search ..... 354/297, 319-324, 354/338, 339; 134/64 P, 72, 73, 122 P, 124-127, 129, 131; 226/170-172, 189

[56] References Cited

U.S. PATENT DOCUMENTS 4,140,384 2/1979 Shintani et al. ..... 354/321

4,174,901 11/1979 Takita et al. ..... 354/322

FOREIGN PATENT DOCUMENTS 2609463 2/1981 Fed. Rep. of Germany .

2951847 7/1981 Fed. Rep. of Germany .

2330035 5/1977 France .

OTHER PUBLICATIONS

European Search Report dated Nov. 18, 1992 for European Patent Application No. 484,739.

*Primary Examiner*—D. Rutledge

*Attorney, Agent, or Firm*—Collard & Roe

[57] ABSTRACT

An insert for paper processors with containers for liquids which are arranged in a working direction one behind the other, whereby each insert includes a rotary endless conveyor belt as means of transportation for photographic material. The conveyor belt extends beyond the width of carrier rollers which are arranged in pairs on the input side and on the output side of the insert, whereby the pair of carrier rollers on the output side constitutes a first squeeze station, since one of these carrier rollers works as a squeeze roller. In addition to the first squeeze station, there is provided a second squeeze station which is adjacent to the first squeeze station.

8 Claims, 3 Drawing Sheets

INSERT FOR PAPER PROCESSORS

BACKGROUND OF THE INVENTION

1. Field of the Invention

The present invention relates to an insert for photographic material processors, in particular for film or photographic paper.

2. The Prior Art

An insert of this kind, known from German Patent No. 2,609,463, is used for developing films or, in general, for developing photographic materials, such as photographic paper.

In this case, it is usual to transport the photographic material successively through several individual tanks in which there are different liquid chemicals. For complete development, the photographic material must be transmitted and transported from one individual tank into the following tank. To transmit the photographic material from one individual tank to the following, conveying the photographic material with conveyor belts from one tank into the other one has already been attempted. However, in this case, there is the danger that a chemical liquid of a certain kind might be transmitted from one individual tank into the following one. This can also happen through a passing conveying belt, such as that through which the photographic material must be transmitted. This contaminates the individual tanks, in a negative way, during a continuous process.

To reduce the transmission of chemical liquids from one individual tank to the following individual tank, the insert known from German Patent No. 2,609,463 provides using one single endless conveyor belt for this insert. This endless conveyor belt extends beyond the full width of the conveyor rolls, which are arranged in pairs at the input and at the output side of the insert. The lower roll at the output side works as a squeeze roll.

This known solution means that liquid will be squeezed out of the film material along its full width at the output side of each individual tank. Because the rolls that are arranged in pairs at the output side of the insert form a squeezing station (the lower situated roll works as a squeeze roll), the photographic or film material can be of different widths.

The known insert already provides a certain improvement. However, in practice, it has been shown that despite the presence of the squeezing station, totally satisfactory development cannot always be ensured. This is due to the fact that despite the presence of the squeezing station, small quantities of the chemical liquid of one individual tank still manage to get into the subsequent individual tank. Consequently, the film material cannot fully absorb the other liquid chemical contained by the next individual tank.

SUMMARY OF THE INVENTION

It is an object of the present invention to provide an improved insert to make possible the optimal development of photographic material.

This provides an important improvement over the insert which is described in the specification and which is known from German Patent No. 2,609,463. This means that during entry by the film material from one individual tank into the following tank, no liquid chemicals can get from the previous tank into the following tank. In addition, the film material shall be processed in an optimal way in order to absorb the other liquid chemical when entering the following individual tank.

The above objects are achieved, according to the present invention, by providing a second squeeze station which joins the first squeeze station.

The objects of the present invention are also accomplished by an insert for photographic material processors with several containers for liquids that are arranged in a working direction one behind the other, whereby they are constructed as individual tanks and filled with a certain chemical liquid comprising: a circulating endless conveyor belt functioning as a conveying element for the photographic material; carrier rollers having the conveyor belt extending beyond the whole width of the carrier rollers; the insert having an input side and an output side, the carrier rollers being arranged in pairs on the input side and on the output side of the insert; the pair of carrier rollers on the output side constituting a first squeeze station as one of the carrier rollers works as a squeeze roller; and a second squeeze station provided adjacent to the first squeeze station.

The invention relates to an improvement over the insert disclosed in German Patent No. 2,609,463, wherein it is not possible to achieve an optimal and effective squeeze when there is only one squeeze station. This is due to the fact that one roll of the known squeeze rolls must function as a carrier roller in order to move and transport the endless conveyor belt. Therefore, at least one of the rollers of the squeeze station must have a rough surface, even though it would be preferable for the squeeze roll to have smooth surfaces located on the squeeze station rolls. This would make it possible to clean the film material in a satisfactory manner of the chemical of each individual tank. However, as previously mentioned, this is not possible because the requirement of one of the squeeze station's carrier rollers is to move the conveyor belt. Therefore, this carrier roller needs a rough surface. However, with a rough surface, an optimal squeeze cannot be achieved.

Thus, the invention provides a second squeeze or compression station, in addition to the first one. This second squeeze station consists of two squeeze or compression rolls. This works out advantageously because it is now possible to form the surfaces of the second squeeze station's rolls in any way. The first squeeze or compression station still transports the endless conveyor belt and has two squeeze or compression rolls, so that the transport no longer has to be taken into consideration. It is also possible to form both squeeze rolls of the second squeeze station with a smooth surface, or alternatively, to form them with a suction or vacuum surface. A combination of both is also possible. In this case, one of the squeeze rolls must have a smooth surface, and the other one must have, a suction or vacuum surface. This results in a greatly improved liquid squeeze out, in both cases. The entry of the photographic material into the second squeeze station and then into the following individual tank ensures the complete removal of the chemical liquid of the previous tank. Therefore, the liquid chemical from one tank cannot reach the following individual tank.

The effect of the second squeeze station with its two squeeze rolls (which may have either a smooth and/or a suction surface, according to the present invention) is that the emulsion on the film material's carrier surface can be prepared like a sponge. Consequently, this carrier surface can be freed of the liquid chemical. After passing through the second squeeze station, the film material is in condition to absorb the liquid chemical of the following tank, without allowing the chemical liquid contained in the previous tank to enter this subsequent tank. Test trials have shown that after this procedure, the development of the film material is greatly improved. On the one hand, this is attributed to the fact that the film material's surface emulsion in the area of the second squeeze station's rolls can be pressed in a sponge-like manner and, therefore, becomes clean afterwards and is able to absorb the other chemical liquid constrained in the following tank. On the other hand, the improvement results from preventing the chemical liquids from passing from one individual tank into the following tank.

According to a further embodiment of the invention, the second squeeze station includes a second stationary lower squeeze roll and a second upper squeeze roll. The upper squeeze roll is movable in a vertical direction, is held in an oblong channel and presses with its dead weight against the lower squeeze roll. Thus, the pressure against the lower squeeze roll (caused by the dead weight of the upper squeeze roll) can be fixed. In other words, an automatic adjustment can be achieved for the different widths of the film material because the upper second squeeze roll is movable in the vertical direction and is able to move upwardly, contrary to its dead weight.

Furthermore, in one preferred embodiment of the invention, there are provided movable and rotatable floating rolls alongside the conveyor belt inside the insert, or rather inside the individual tank. These rolls are freely movable obliquely to the working direction of the conveyor belt. This embodiment leads to the advantage that the rotatable floating rolls can force a certain pressure against the conveyor belt, or rather against the photographic material. This pressure is caused by the chemical liquid in the individual tank, which brings about a buoyant lifting force affecting the rotatable floating rolls. These floating rolls can be placed in oblique oblong holding channels aligned obliquely upwardly facing inwardly towards the center of the insert in the direction toward the conveyor belt obliquely from the lower side to the upper side. Due to the buoyant, lifting force, the floating rolls move in the direction provided by the oblong channels or holes. This means that they move in an oblique direction which contains a vertical and a horizontal movement. The horizontal movement is inwardly toward the center of the insert and, in this case, is responsible for the pressure against the photographic material.

This pressure, which is forced against the photographic material by the floating rolls, is advantageous for improving the directional movement of the film material through the individual tank by pressing the photographic material against the conveyor belt. This prevents the photographic material from being left behind in an individual tank, which would cause the transport to become unsafe. The floating rolls, themselves, are without any external rotational force. However, they can rotate because they press against the film material, or rather press against the conveyor belt, with a certain pressure.

The fact that the floating rolls can rotate results in the advantage that after stopping the entire apparatus, there will be almost no chemical tailing on the surfaces of the floating rolls of the invention which can be seen on the stationary immovable prior art rolls. When starting the apparatus with prior art rolls that had been stopped, it is necessary to pass through the individual tank a material, for example, paper, to remove the chemical tailing before allowing photographic material to pass through. According to the invention, it is, on the contrary, only necessary to allow the apparatus to work without any paper for a short time. The floating rolls will be cleaned when they touch the conveyor belt.

According to another embodiment of the invention, there is provided another additional guiding belt, in the lower part of the insert, where the conveyor belt changes direction and turns through about 180°. This additional guiding belt presses the photographic material against the conveyor belt and is moved by at least one drive roller. The guiding belt is turned around in an advantageous manner by a lower weight roller located in the lower part or bottom of the insert. This weight roller is freely movable in the vertical direction. The result is that the guiding belt is kept tight and taut by the dead weight of the weight roller. As a result of the presence of this feature, a certain pressure is placed on the emulsion of the photographic material's carrier surface in the area of the photographic material's deflection. The freely movable lower weight roll automatically tightens the guiding belt, due to its dead weight. Consequently, it is ensured tat in cases wherein thicker photographic material is used, an automatic adjusting of the pressure is made. If tensioning of the guiding belt is fixed and would, therefore, also set the pressure, it could happen that the guiding belt borders become irregular so that a correct guiding is no longer ensured. However, as previously mentioned, this difficulty is prevented according to the invention. On the contrary, the automatic adjustment of the pressure and the tightening of the guiding belt by the free lower weight roll ensures a very safe guiding of photographic material.

According to a further advantageous embodiment of the invention, another upper weight, freely movable roller is provided in the upper part or top of the insert and exerts a pressure in the downward direction. This roller presses, with its dead weight, against the conveyor belt. Thus, the conveyor belt is automatically kept taut and tight. Since the upper weight roller is freely movable in the vertical direction, it is, therefore, able to adjust its position to the present situation and to the tension of the conveyor belt. Consequently, the conveyor belt is automatically kept tight and taut, thus ensuring a safe transport of the photographic material through the individual tank.

BRIEF DESCRIPTION OF THE DRAWINGS

Other objects and features of the present invention will become apparent from the following detailed description considered in connection with the accompanying drawings, which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
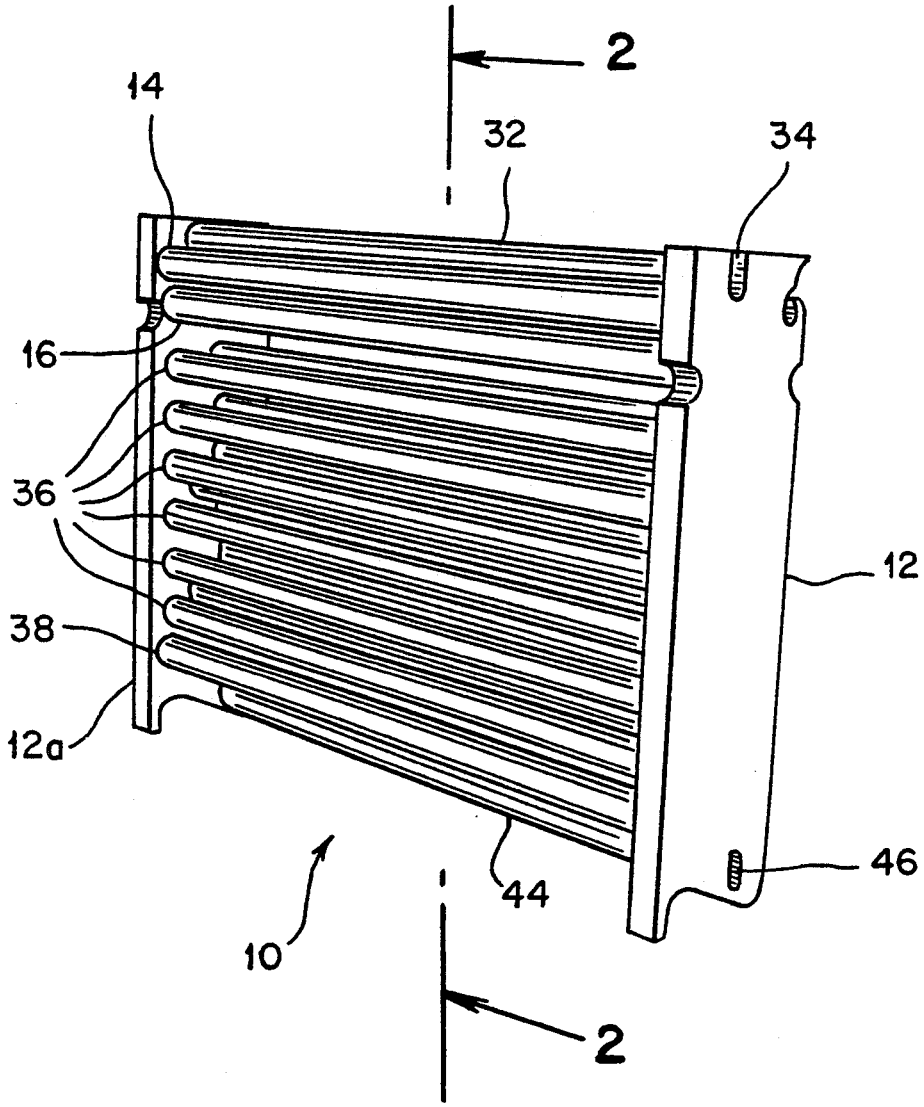
FIG. 1 shows a perspective view of an insert with its rollers.

Turning now in detail to the drawings, the insert 10 in FIG. 1 includes two side walls 12 and 12*a*. In between these walls are several rolls, which will be explained by reference to FIG. 2. These rolls are embedded in openings and oblong holes, which will be explained by reference to FIG. 3. The insert 10 is placed within an individual tank, which is conventional and is not explained in detail. This tank is filled with a chemical liquid. Its liquid level is represented by reference numeral 50 in FIG. 2.

Figure 2:
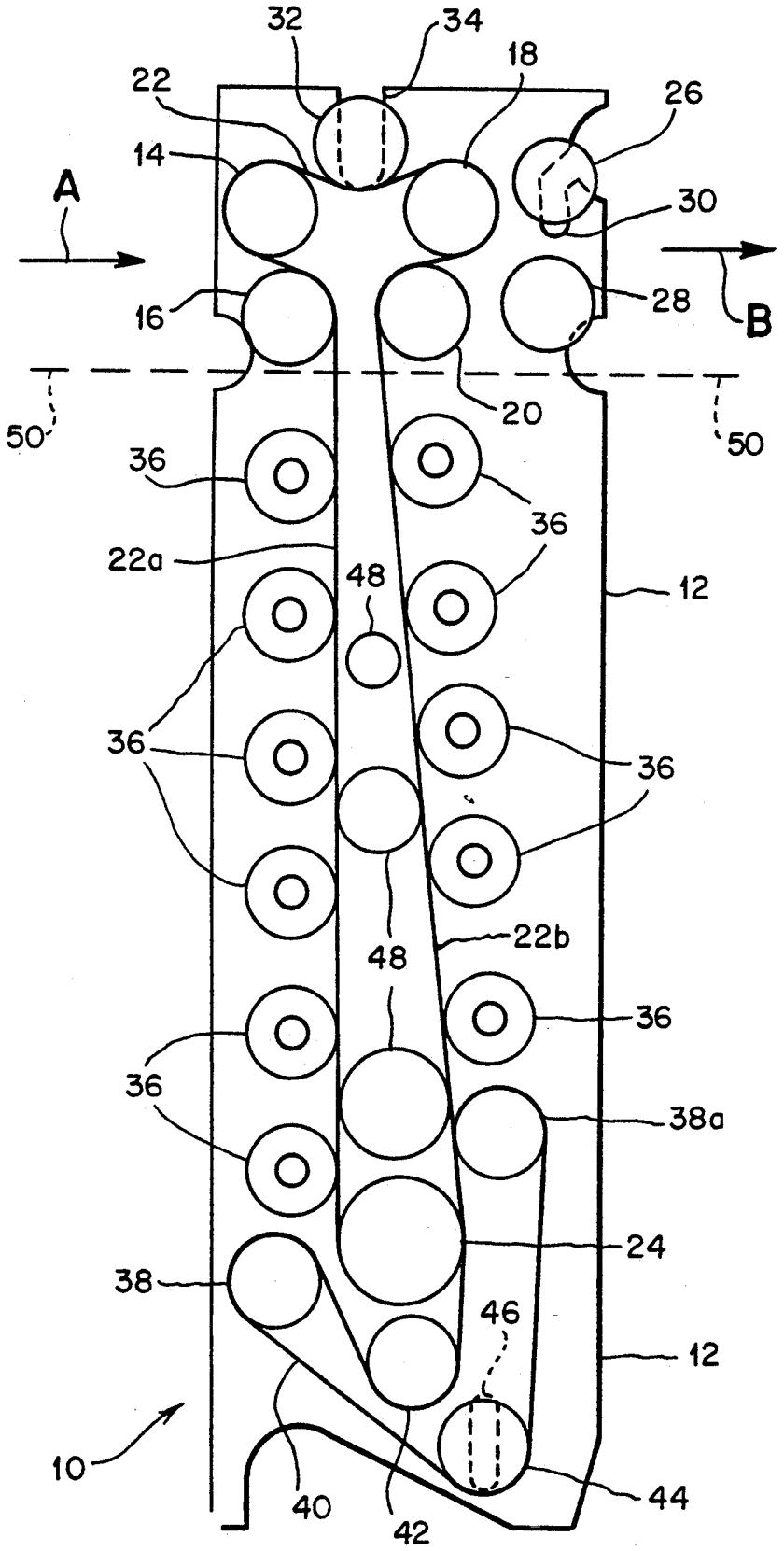
FIG. 2 shows a cross-sectional view of the insert along line 2—2 of FIG. 1.

According to the representation in FIG. 2, insert 10 includes an endless conveyor belt 22 with its carrier rollers 14, 16, 18 and 20. At least one of these carrier rollers has a motor or drive means to move the endless conveyor belt 22.

In FIG. 2, the arrow A marks the input side where the photographic material that is being processed can be fed in from the left side between the two carrier rollers 14 and 16. Through the individual tank, the carrier belt leads the photographic material to the output side, which is marked by arrow B. On the output side B, there are two carrier rollers 18 and 20 which constitute the first compression or squeeze station. In addition, there is a second compression or squeeze station which is constituted by the upper squeeze or compression roll 26 and the lower squeeze or compression roll 28. The upper squeeze roll 26 is embedded in an oblong channel hole 30, and it is freely movable in the vertical direction. The oblong hole 30 is located in the side wall 12. In FIG. 2, the upper squeeze roll 26 is shown to be spaced a distance above the lower squeeze roll 28. However, in fact, the upper squeeze roll 26 is adjacent to lower roll 28, due to its dead weight (the film material is not shown in FIG. 2). This is possible because of the upper squeeze roll's mobility. (The film material which is not shown is led by the two squeeze carriers through the output side B to the next following, or subsequent, individual tank.)

The conveyor belt 22, which is guided around the guiding roll 24 in the bottom area of insert 10, is kept tight and taut by a weight roll 32 pressing on the upper end of the belt 22. This upper weight roll 32 is freely movable in the vertical direction and is embedded in an oblong hole 34 which is located in the side wall 12 at the top end thereof. In the lower part of the insert 10, there is another guiding belt 40 which contacts the conveyor belt 22. This guiding belt 40 is moved by drive rollers 38 and 38*a* and is guided by a guiding roll 42 and a lower weight roll 44. Guiding belt 40 is moved at the same speed as conveyor belt 22. In the area of conveyor belt 22's lower guiding roll 24, the guiding belt 40 presses against conveyor belt 22, or rather, against the photographic material which is located therebetween up to the height of drive roll 38*a*. This results in safely contacting the photographic material, or rather, the conveyor belt 22 in the area of the guiding belt 40. The lower weight roll 44 is freely movable in the vertical direction and is held within and positioned within an oblong hole 46, which is located in the bottom of side wall 12 (as also seen in FIG. 1). Due to its dead weight, weight roll 44 exerts downward pressure on guiding belt 40. Therefore, guiding belt 40 is automatically kept tight and taut. To improve the safe guidance of conveyor belt 22 to an even greater degree, there are provided center replacement rolls 48 which are situated between upwardly and downwardly moving sections of the conveyor belt.

Figure 3:
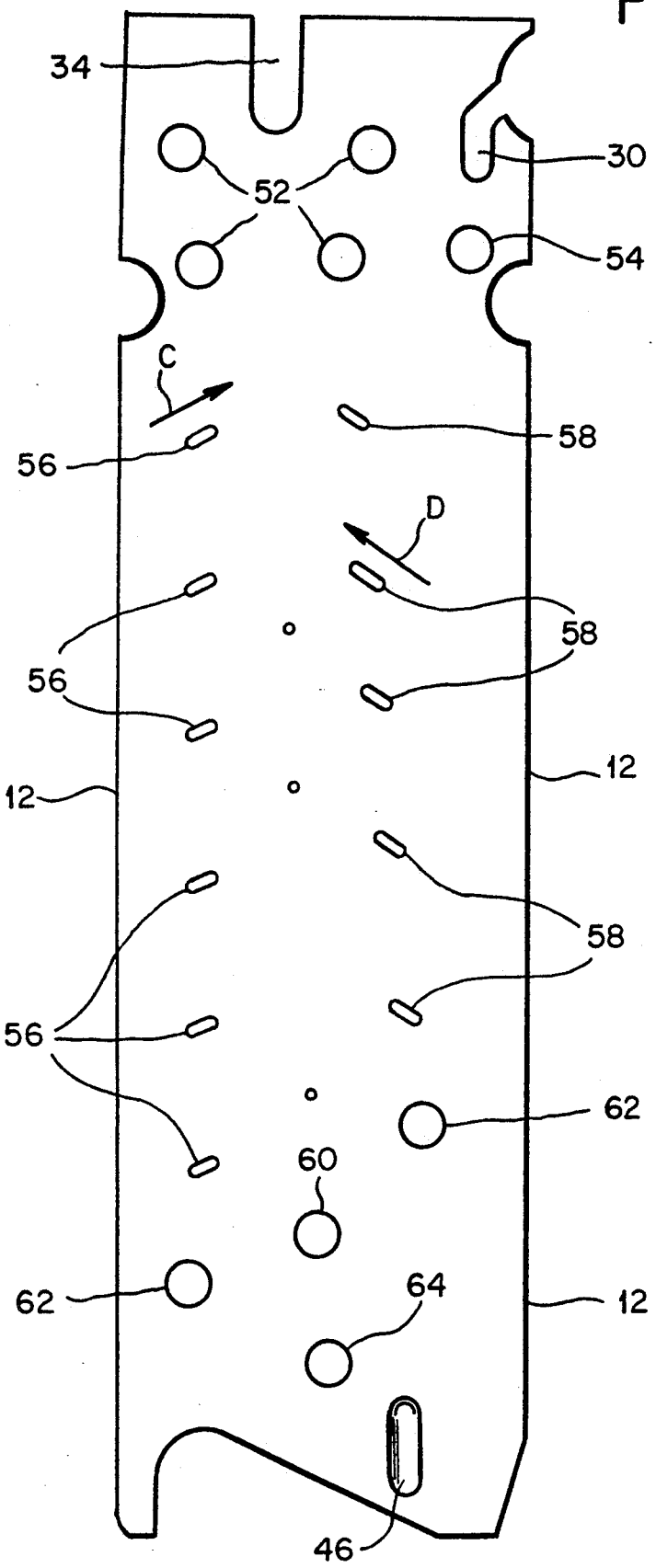
FIG. 3 shows a representation of the insert's side wall, wherein the rollers are embedded.

In addition, the insert 10 includes several floating rolls 36 which are, according to FIG. 3, embedded, held and positioned in obliquely located oblong holes 56 and 58 in the side walls 12 and 12*a*. There are several floating rolls situated in a row on the downwardly leading portion 22*a*, as well as on the upwardly leading portion 22*b* of the conveyor belt 22. As shown by liquid level 50, floating rolls are under this level. This means that they are within the chemical liquid of the individual tank. Due to displacement of this chemical liquid, a buoyant lifting force is generated and acts on floating rolls 36. Therefore, they exert a certain upward pressure against the film material which is guided by conveyor belt 22. According to FIG. 3, oblong holes 56 which contain floating rolls 36 have an oblique direction from the lower side to the upper side inwardly toward the center of the insert in the direction of the conveyor belt. This direction is denoted, in FIG. 3, by arrow C for left row 56 and by arrow D for the right row of oblong holes 58. Due to the buoyant, lifting force, the floating rolls follow oblique directions C and D and press with a horizontal component against the conveyor belt 22, or rather, against the photographic material which is guided by the conveyor belt. The desired pressure can be adjusted by varying the weight of floating rolls 36.

The various floating rolls are movably held in position by such conventional means as a screw thread means, pin means, or key means.

FIG. 3 shows bore holes 52, wherein carrier rolls 14, 16, 18 and 20 are embedded, held and positioned and bore holes 54 for the lower squeeze roll 28. There are also shown, in the lower part of side wall 12, bore hole 60 for guiding roll 24, bore holes 62 for the bearing of the lower guiding belt 40, drive rollers 38 and 38*a* and bore hole 64 for guiding roll 42. Furthermore, there is also shown oblong hole 46 for weight roll 44 that is freely movable in the vertical direction.

While only a few embodiments of the present invention have been shown and described, it is to be understood that many changes and modifications may be made thereunto, without departing from the spirit and scope of the invention as defined in the appended claims.

What is claimed is:

1. An insert for photographic material processors with several containers for liquids that are arranged in a working direction one behind the other, in which each container is constructed as an individual tank and filled with a certain chemical liquid, said insert having an input side and an output side, comprising:

a circulating endless conveyor belt being a conveying element for the photographic material;

carrier rollers for moving the conveyor belt which extends beyond the whole width of the carrier rollers;

said carrier rollers being arranged in pairs on the input side and on the output side of the insert;

the pair of carrier rollers on the output side constituting a first squeeze station with one of the carrier rollers being a squeeze roller;

a second squeeze station located between the first squeeze station and the output side of the insert;

wherein the second squeeze station comprises a second stationary lower squeeze roll and a second upper squeeze roll which is movable in the vertical direction and is held in an oblong hole; and said second upper squeeze roll presses with its dead weight against the second lower squeeze roll.

2. The insert according to claim 1, wherein at least one of the two second squeeze rolls has a smooth surface.

3. The insert according to claim 1, wherein at least one of the two second squeeze rolls has a vacuum holding surface.

4. The insert according to claim 3, wherein the vacuum holding surface is made with a felt coating.

5. The insert according to claim 1, further comprising movable and rotatable floating rollers alongside the conveyor belt which are freely movable obliquely to the conveyor belt working direction and which are pressing against the conveyor belt and against the photographic material, which is caused by the buoyant, lifting force of the chemical liquid inside the individual tank.

6. The insert according to claim 1, further comprising a guiding belt in the lower part of the insert where the conveyor belt is turned around;

said guiding belt pressing the photographic material against the conveyor belt; and at least one drive roller for driving said guiding belt.

7. The insert according to claim 6, further comprising a lower weight roll;

wherein the guiding belt is turned around by said lower weight roll which is freely movable in the vertical direction; and said guiding belt is kept tight by the dead weight of the lower weight roll.

8. The insert according to claim 1, further comprising an upper weight roll which is freely movable in the vertical direction and which presses with its dead weight against the conveyor belt, thereby keeping the conveyor belt taut and tight.

* * * * *